United States Patent [19]

Scharrer

[11] 4,026,051

[45] May 31, 1977

[54] DATA-INDICATING DEVICE

[76] Inventor: Hans Wilhelm Scharrer, Further Strasse 4b, Nurnberg, Germany

[22] Filed: Jan. 26, 1976

[21] Appl. No.: 652,612

[52] U.S. Cl. ..... 40/113; 116/133

[51] Int. Cl.[2] ..... G09D 3/08

[58] Field of Search ..... 116/133, 129 S, 130; 35/74; 40/113

[56] References Cited

UNITED STATES PATENTS 2,022,632 11/1935 Woodford ..... 116/133

FOREIGN PATENTS OR APPLICATIONS 1,142,654 9/1957 France ..... 40/113

452,827 11/1927 Germany ..... 40/113

422,637 12/1925 Germany ..... 40/113

113,755 2/1926 Switzerland ..... 40/113

*Primary Examiner*—S. Clement Swisher

*Assistant Examiner*—Denis E. Corr

[57] ABSTRACT

A data-indicating device having a multitude of data-carrying discs arranged in a casing wherein at least one of the discs has a transparent inner portion and an outer peripheral portion and the discs are arranged such that the data carried by the other discs shows through the transparent inner portion of the one and are viewable through apertures in the front cover of the casing. An embodiment as a perpetual calendar is disclosed.

9 Claims, 4 Drawing Figures

Fig. 3
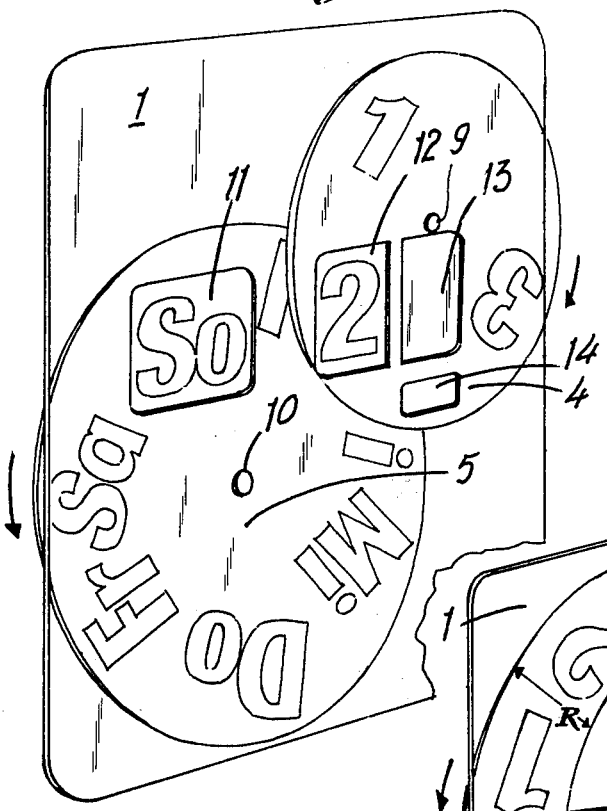
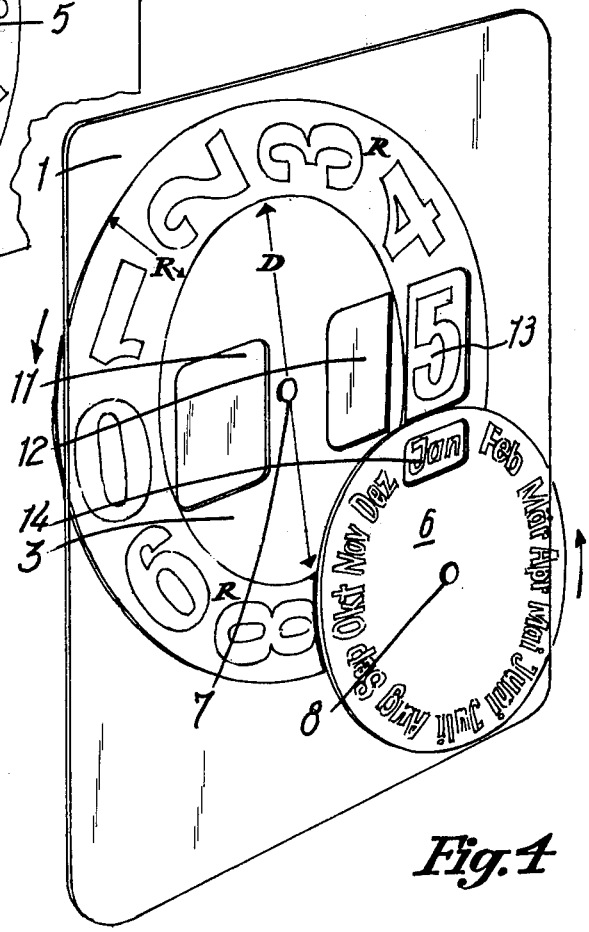
Fig. 4

DATA-INDICATING DEVICE

BACKGROUND OF THE INVENTION

This invention relates to a data-indicating device, particularly but not exclusively to a perpetual calendar.

The invention provides a data-indicating device comprising a plurality of rotatable disc-shaped members carrying data selectively viewable through see-through portions of a cover, at least one of the disc-shaped members having an outer peripheral portion carrying data and an inner portion through which data on a further data carrier arranged behind the inner portion is selectively viewable.

As a result, a relatively-large data-displaying area in relation to the total surface area of the device is obtainable because of the see-through inner portion of at least one of the discs. This see-through portion may be provided by forming the inner portion of the disc of transparent material.

Preferably, the device comprises a first rotatable disc having a transparent inner portion and an outer peripheral portion carrying data and a second rotatable disc carrying data and arranged behind the first disc, the data on the second disc being selectively viewable through the transparent inner portion of the first disc.

It is the object of the present invention to obtain, in an indicator device of the above-mentioned type, an increase of the area for listing and reading of the numbers of the date-listings or similar data, without thereby necessitating an increase of the outer dimensions of the calendar or similar indicator device.

Thus, in comparatively small peripheral portions of the calendars, the area-section which is available for displaying the data, in comparison to the total area of the calender, can be made relatively large. It is now possible to make available area-portions which formerly could not be utilized for displaying the dates, on the basis of the above-explained transparency of the see-through portion. This produces the advantage that in comparatively small calendar-dimensions the dates to be displayed can be kept relatively large and therefore will enable a clearer reading of the dates from a greater distance.

It is thus possible that the first disc-shape member of a preferably larger diameter may be selected in such a size so that it obtains approximately the external diameter of the calendar or indicator device, or its cover plate, whereby the dates, which have to be displayed on that portion of the periphery of the disc, can be accordingly large. Additionally, it provides for a greater freedom in the selection of the diameter and the positioning of the further disc of the calendar or indicator device. For the disc which is proposed to be positioned behind the transparent portion of the first disc, it will suffice if the portion of the disc carrying the dates is located behind the transparent portion of the first disc, i.e., being in alignment with the corresponding see-through portion of the cover plate.

In the preferred area of application of the instant invention, namely, in a permanent calender device, the outer closed or non-transparent cover portion of the first disc, having a larger diameter can serve for the units-digits of the months and the second disc of the smaller diameter can serve as the carrier for the tens-digits of the months, whereby the discs are measured to such an extent, and are arranged to the see-through portions of the cover plate so that the tens-digit numbers can be placed behind one see-through portion which is located at the left adjacent the see-through portion of the cover plate for the units-numbers. This will permit a large amount of numbers to be assigned to the larger disc, namely, the units-numbers, from 0–9, while in comparison thereto the smaller disc must be provided with only the numbers 1, 2 and 3, wherefore their circumference will suffice completely.

BRIEF DESCRIPTION OF THE DRAWINGS

The invention will now be described with reference, by way of example, in the accompanying drawings, wherein:

FIG. 3 is a perspective view of the calendar of FIG. 1 showing two discs,

FIG. 4 is a similar view to FIG. 3 showing two further discs.

DETAILED DESCRIPTION OF A PREFERRED EMBODIMENT

Figure 1:
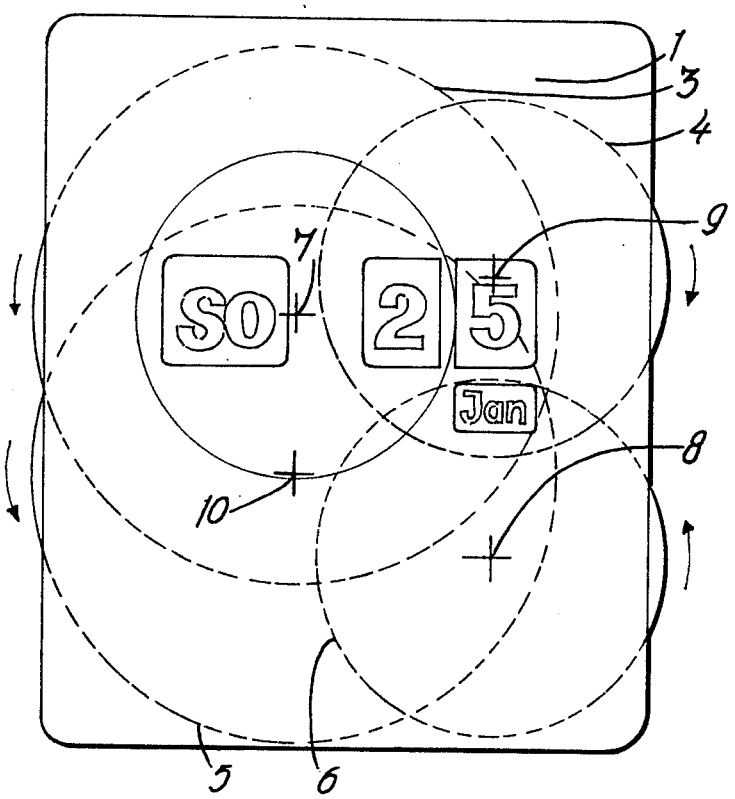
FIG. 1 is a front view of a perpetual calendar.
Figure 2:
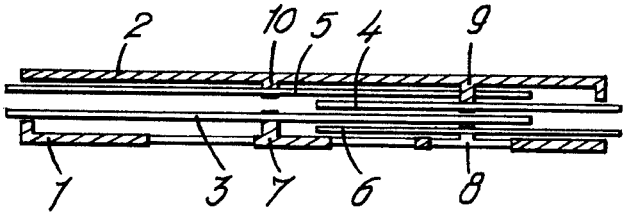
FIG. 2 is a partially-sectioned plan view of FIG. 1.

In the embodiment shown in FIGS. 1 to 4, a perpetual calendar comprises essentially a front cover plate 1, a back plate 2, a first disc 3, a second disc 4, a third disc 5 and a fourth disc 6. The discs 3 and 6 are rotatably journalled at 7 and 8, respectively, on the cover plate 1, and the discs 4 and 5 are rotatably journalled at 9 and 10, respectively, on the back plate 2. Apertures 11 to 14 (FIG. 3) are cut out of the cover plate 1 and the particular day of the week, tens-digit date number, units-digit date number and the month, respectively, can be seen through the apertures.

The first disc 3 has an inner portion D (FIG. 4) of transparent material, and an adjacent annular peripheral portion R of opaque material on which the units-digit of the date is marked.

The smaller second disc 4 carries the tens-digit of the date and is situated behind the disc 3. The discs 3 and 4 are so dimensioned and arranged in such a manner that the tens-digits of the disc 4 are positioned behind the transparent portion of the disc 3, when they are in alignment with the aperture 12. For clarification, the front cover plate 1 with its apertures 11 to 14 is also shown in FIGS. 3 and 4. It should be remembered that the cover plate 1 is positioned in front of the discs illustrated.

The first disc 3 is approximately as large as the external dimensions of the cover plate 1, i.e., of the calendar, thereby obtaining the desirable size of the units-digits. The size of the tens-digits of the plate 4 may be adapted thereto without any difficulty.

The third disc 5 is also situated behind the first disc 3 the second disc 4. The diameter of the third disc 5 is preferably equal the diameter of the first disc 3. On its marginal area, it bears the abbreviations of the days of the week, and is also so dimensioned and journalled at 10 that the weekday symbols are situated behind the transparent inner portion D of the first disc upon being aligned with the aperture 11. In this embodiment, the journal point 9 of the second disc 4 is situated to the right of and above the journal point 7 of the first disc 3, and the journal point 10 of the third disc is situated below the journal point 7 of the first disc. The journal point 7 is also situated approximately at the center of the cover plate, so that the journal points 9 and 10 are situated in corresponding offset positions in the back plate 2. The fourth disc 6 is situated between the first disc 3 and the cover plate 1 and bears the months' symbols on a peripheral portion.

Each of the discs projects beyond the corresponding lateral edge of the cover plate 1 and of the back plate 2, so that it may be grasped and turned.

Almost all the components of the above-described embodiments may be produced of plastics materials in the simplest manner possible, e.g., by injection. In the embodiment of FIGS. 1 to 4, only the journals need to be added, if they have not also been integrally injection molded, and a connection between the cover plate 1 and the back plate 2 must be provided.

What I claim is:

1. An indicator device, having a multitude of data-carrying rotatable discs, wherein the indications of the discs are visible through portions of a frontal cover plate of a casing, comprising:

a cover plate having apertures;

at least one first disc of the discs being rotatably mounted on a first pivot and being provided with an inner portion comprising a transparent material, and having an outer, non-transparent peripheral portion, the non-transparent peripheral portion of the first disc serving as a data-carrier means;

a second disc being arranged behind the first disc and being rotatably mounted on a second pivot offset with respect to the first pivot;

a third disc being arranged behind said second disc and being rotatably mounted on a third pivot offset with respect to the first and the second pivots;

the second disc being arranged between the first disc and the third disc in such a fashion so that the data carried by the second disc arrives to be positioned behind the transparent inner portion adjacent the data of the peripheral portion of the first disc, and the third disc disposed with its data also behind the transparent inner portion of the first disc.

2. The indicator device according to claim 1, wherein the first disc is rotatably positioned with its centrical pivotal point of its transparent inner portion on the front cover plate, and the second and the third discs are rotatably positioned each on the rear wall of the casing by means of centrical pivotal points, and the diameter of the third disc is identical with the diameter of the first disc.

3. The indicator device according to claim 2, wherein the pivotal point of the first disc is placed approximately in the center to the cover plate and the position of the pivotal points of all discs and their outer peripheries with regard to the dimensions of the casing are selected in a manner and are set off to each other so that the edges of each disc are engagable on the lateral edges of the casing for the purpose of rotating same.

4. The indicator device according to claim 3, wherein seen in the viewing-direction the pivotal point of the second disc, having the smaller diameter, is located at the right from the pivotal point of the first disc and the pivotal point of the third disc is positioned below the pivotal point of the first disc.

5. The indicator device according to claim 1, wherein for the purpose of reducing the dimensions of the casing the second disc has a smaller diameter than the first disc.

6. The indicator device according to claim 1, wherein on the frontal cover plate there is rotatably positioned a fourth disc, with a pivotal point being centrically positioned thereto, whereby this pivotal point is in off-set placement with respect to the first disc, and this fourth disc, which is located between the first disc and the covering plate, has a smaller diameter than the first disc for the purpose of reducing the dimensions of the casing.

7. The indicator device according to claim 6, wherein the data carried by the first disc is the units-digits of the days of the months, the data carried by the second disc is the tens-digits of the days of the months, the data carried by the third disc is abbreviations of the days of the week, and the data carried by the fourth disc is the abbreviations of the months.

8. The indicator device according to claim 1, wherein the discs, the cover plate and the rear plate are made of a plastic material.

9. The indicator device according to claim 1, wherein the data carried by the first disc is the units-digits of the days of the months, the data carried by the second disc is the tens-digits of the days of the months, and the data carried by the third disc is abbreviations of the days of the week.

* * * * *